US008458866B2

(12) United States Patent
Hancz

(10) Patent No.: US 8,458,866 B2
(45) Date of Patent: Jun. 11, 2013

(54) BAG SPREADER FOR A CONTAINER

(76) Inventor: Eric Hancz, McKinney, TX (US)

( * ) Notice: Subject to any disclaimer, the term of this patent is extended or adjusted under 35 U.S.C. 154(b) by 196 days.

(21) Appl. No.: 12/878,437

(22) Filed: Sep. 9, 2010

(65) Prior Publication Data

US 2011/0079597 A1 Apr. 7, 2011

Related U.S. Application Data

(60) Provisional application No. 61/248,016, filed on Oct. 2, 2009.

(51) Int. Cl.
*B65B 67/04* (2006.01)

(52) U.S. Cl.
USPC ..... 24/555; 248/99; 248/101; 248/213.2; 248/316.7; 294/214

(58) Field of Classification Search
USPC .. 24/555; 248/99, 101, 213.2, 316.7; 294/214
See application file for complete search history.

(56) References Cited

U.S. PATENT DOCUMENTS

| | | | | | |
|---|---|---|---|---|---|
| 313,515 | A | * | 3/1885 | Parker | 248/99 |
| 2,451,829 | A | | 10/1948 | Hightower | |
| 3,240,457 | A | * | 3/1966 | Backlund et al. | 248/99 |
| 3,604,677 | A | * | 9/1971 | Gits | 248/97 |
| 3,697,030 | A | * | 10/1972 | Schultz | 248/101 |
| 3,747,653 | A | * | 7/1973 | Ringer | 383/12 |
| 3,779,419 | A | | 12/1973 | Heitz | |
| 3,784,049 | A | * | 1/1974 | Hawk | 220/495.11 |
| 4,023,842 | A | * | 5/1977 | Harvey | 248/99 |
| 4,440,430 | A | * | 4/1984 | Kruse | 294/214 |
| 4,535,911 | A | | 8/1985 | Goulter | |
| 4,735,340 | A | | 4/1988 | Preston | |
| 4,763,808 | A | | 8/1988 | Guhl et al. | |
| 4,934,637 | A | | 6/1990 | Guerrera | |
| 4,946,065 | A | * | 8/1990 | Goulter et al. | 220/495.1 |
| 5,000,406 | A | | 3/1991 | Petersen | |
| 5,028,022 | A | | 7/1991 | Metcalf | |
| 5,125,605 | A | | 6/1992 | Guerrera | |
| 5,150,809 | A | | 9/1992 | Leigh | |
| D371,659 | S | * | 7/1996 | Goldman | D34/6 |
| 5,570,862 | A | * | 11/1996 | Nugent | 248/97 |
| 5,639,050 | A | * | 6/1997 | Peterson et al. | 248/97 |
| 5,718,400 | A | * | 2/1998 | Dwy | 248/99 |
| 6,488,243 | B2 | * | 12/2002 | Kim | 248/100 |
| 6,679,462 | B1 | | 1/2004 | Valdez | |
| 2004/0200938 | A1 | | 10/2004 | Forlivio | |
| 2008/0191103 | A1 | | 8/2008 | Thurgar | |

FOREIGN PATENT DOCUMENTS

| | | |
|---|---|---|
| JP | 2002167004 | 6/2002 |

* cited by examiner

*Primary Examiner* — Robert J Sandy
*Assistant Examiner* — David Upchurch
(74) *Attorney, Agent, or Firm* — Haynes & Boone, LLP

(57) ABSTRACT

A bag spreader for spreading a bag in a container lying on its side includes a connection portion arranged to interface with the upwardly facing outer surface of the container when the container is oriented on its side and includes a bag supporting portion arranged for insertion into the bag and the container. The bag supporting portion may be disposed adjacent the upper sidewall of the container in a manner that supports the bag in an open condition when the container is oriented on its side. A head portion connects the connection portion and the bag spreading portion with the connection portion and the bag supporting portion being spaced apart on the head portion a distance sufficient to receive an edge of the container.

21 Claims, 9 Drawing Sheets

BAG SPREADER FOR A CONTAINER

PRIORITY

This application claims priority to and is a non-provisional application of U.S. Provisional Application No. 61/248,016, titled, Bag Spreader for a Receptacle, and filed on Oct. 2, 2009, which is incorporated herein by reference.

FIELD OF THE INVENTION

This application relates to a bag spreader that aids in holding a bag open in a container tipped on its side.

BACKGROUND

Each autumn season, homeowners and yard workers spend substantial amounts of time bagging leaves to be hauled away for disposal. However, it can be difficult to actually place the leaves in the bags without some type of supporting structure for the bags, such as a garbage can. Bagging leaves in an upright can requires picking up the leaves, for example, by hand or with a rake, and then dropping or stuffing them into the bag and can openings. This is time consuming and tedious. Tipping the can on its side permits a user to rake or push leaves into the band and can openings without picking them up, but the bag can still become displaced relative to the can, requiring the user to readjust the bag. In addition, because the bag may be held open only at the can opening, the bag body inside the can is unsupported and hangs down. As leaves and other debris are thrust inside the bag, they substantially displace the hanging bag, potentially tearing the bag.

What is needed is an improved bag spreader for container that helps secure the bag for easier filling. The subject matter of the present disclosure overcomes one or more of the shortcomings of the prior art.

SUMMARY

The present disclosure is directed to a bag spreader for a container that spreads a bag in the container for filling. In one example, the bag spreader secures the bag in place while supporting the bag internally to reduce the chance of tearing. This bag spreader may permit a user to rake the leaves into the bag and container openings when the container is on its side. The spreader may hold the bag at the container edge and internally to reduce the chance of tearing the bag as leaves or other debris are forced to the bottom end of the container.

In one exemplary aspect, the present disclosure is directed to a bag spreader for spreading a bag in a container lying on its side such that the container opens on a lateral side and such that the container includes an upper sidewall having an upwardly facing outer surface. The bag spreader includes a connection portion arranged to interface with the upwardly facing outer surface of the container when the container is oriented on its side and includes a bag supporting portion arranged for insertion into the bag and the container. The bag supporting portion may be disposed adjacent the upper sidewall of the container in a manner that supports the bag in an open condition when the container is oriented on its side. A head portion connects the connection portion and the bag spreading portion with the connection portion and the bag supporting portion being spaced apart on the head portion a distance sufficient to receive an edge of the container.

In some aspects, the bag spreader further comprises an attachment element extending from the head portion. The attachment element may be configured to interface with the container to help secure the bag spreader to the container. The attachment element may be a compliant mechanism arranged to flex to extend over a lip of the container when the bag spreader is being attached or removed from the container.

In some aspects, the bag supporting portion is arranged to cooperate with the container to extend into the container more than 15% of the depth of the container. In some aspects, the head portion comprises a grip configured to be grasped by a user when attaching or removing the spreader from the container.

In some aspects, the connection portion comprises a first plurality of legs and wherein the bag supporting portion comprises a second plurality of legs. The first plurality of legs may be spaced apart from each other by a first distance and the second plurality of legs may be spaced apart from each other by a second distance. The second distance may be greater than the first distance.

In some aspects, the connection portion extends substantially parallel to the bag supporting portion, and the connection portion comprises a protruding portion protruding toward the bag supporting portion to interface with the outer surface of the container and orient the bag spreader. In some aspects, the bag supporting portion comprises a rounded or tapered distal end. In other aspects, the connection portion extends from the head portion by a first length and the bag supporting portion extends from the head portion by a second length, the second length being greater than the first length.

In a second exemplary aspect, the present disclosure is directed to a bag spreader for spreading a bag in a container. The bag spreader includes a first plurality of legs lying substantially in a first plane, the first plurality of legs being arranged to interface with an outer surface of the container. It also includes a second plurality of legs lying substantially in a second plane. The second plane may be substantially parallel to the first plane and the second plurality of legs may be arranged for insertion into the container and into the bag in the container in a manner that supports the bag a distance spaced from the container opening. The first and second planes may be offset a distance sufficient to receive an edge of the container such that when the first plurality of legs interfaces with the outer surface of the container, the second plurality of legs is disposed within the container. A head portion may connect the first and second plurality of legs.

In some aspects, the bag spreader includes an attachment element extending from the head portion, the attachment element being configured to interface with the container to help secure the bag spreader to the container.

In some aspects, the head portion comprises a grip configured to be grasped by a user when attaching or removing the spreader from the container. In some aspects, the first plurality of legs comprises a protruding portion protruding toward the second plurality of legs. In some aspects, each leg of the first and second pluralities of legs have rounded or tapered leading edges.

In some aspects, the first plurality of legs comprises two substantially parallel legs and the second plurality of legs comprises two substantially parallel legs. In some aspects, the second plurality of legs have a length greater than the first plurality of legs.

In another exemplary aspect, the present disclosure is directed to an assembly including a container and a bag spreader. The container includes a container open end and a container closed end and is configured to receive a bag therein. The container is tippable onto its side so that material can be directed directly from the ground into the container. The bag spreader is at least partially receivable in the container open end. It is structurally configured to interface with the container at the container opening and structurally configured to extend into the container toward the closed end of the container to support the inside of a bag within the container at a location spaced from the container opening.

In some aspects, the bag spreader includes a connection portion arranged to interface with the upwardly facing outer surface of the container when the container is oriented on its side and a bag supporting portion arranged for insertion into the bag and the container. The bag supporting portion may be disposed adjacent the upper sidewall of the container in a manner that supports the bag in an open condition when the container is oriented on its side. The bag spreader also may include a head portion connecting the connection portion and the bag spreading portion.

BRIEF DESCRIPTION OF THE DRAWINGS

Aspects of the present disclosure are best understood from the following detailed description when read with the accompanying figures.

DETAILED DESCRIPTION

Figure 1:
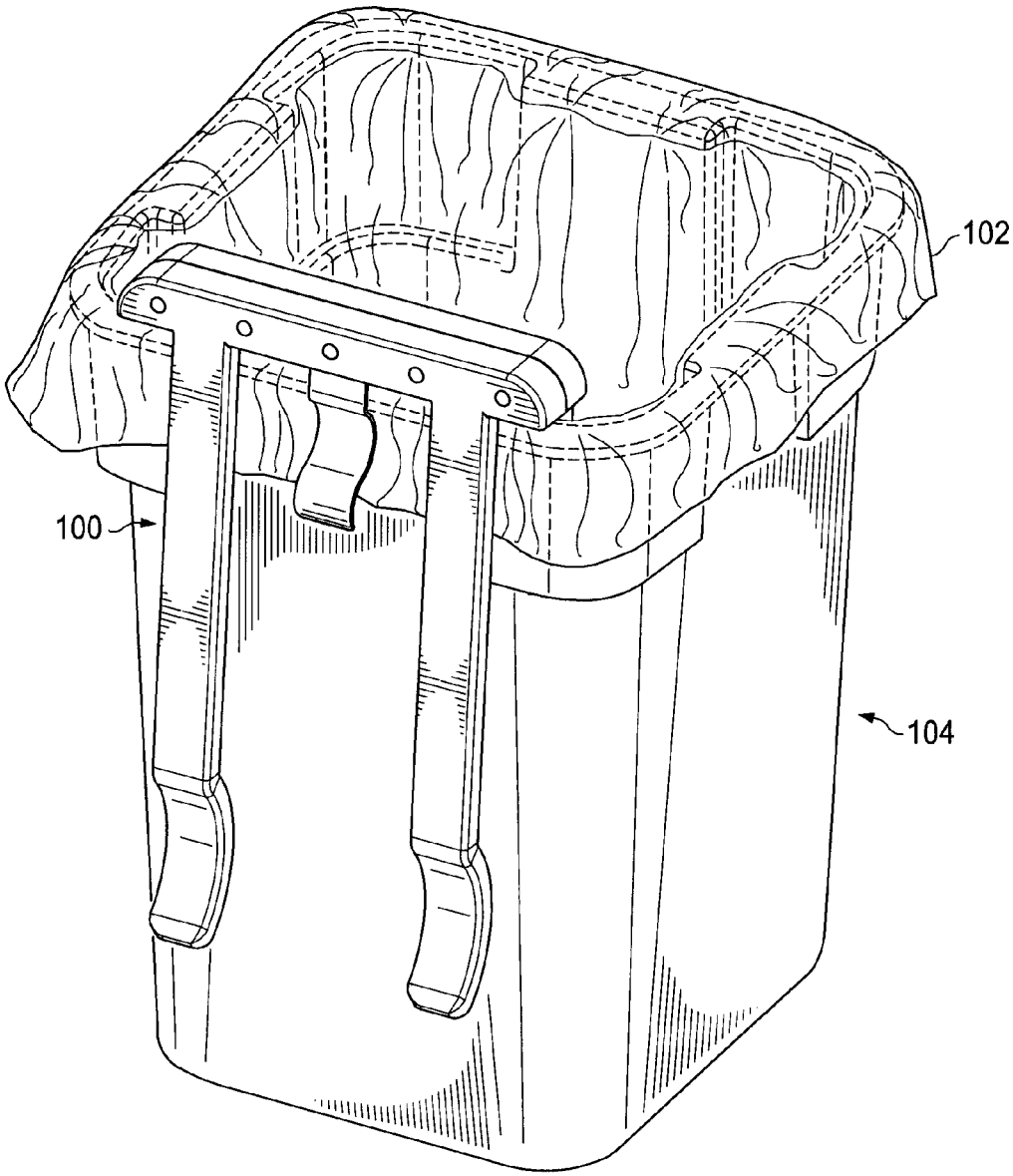
FIG. 1 is an illustration of a system including an exemplary bag spreader with a container and a bag.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The bag spreader described herein simplifies bagging of leaves or other debris by securing a leaf bag or other bag in place in a container so that it can be easily filled. To do this, the bag spreader is not only arranged to hold the bag at the container opening, but is also arranged to extend into the container opening to support or hold the bag open within the container. This becomes particularly helpful when the container is tipped on its side and leaves or other debris are pushed or raked directly into the container opening. Because the bag spreader extends into the container opening to support the bag, it reduces or eliminates bag sagging near the container opening. Because of this, users can push leaves and debris into the bag and container with a reduced chance of snags or tearing of the bag. When the bag is filled, the container can be uprighted and the bag spreader can be easily removed, leaving the bag to be tied.

FIG. 1 illustrates an exemplary bag spreader 100 of the present disclosure joined with a bag 102 and a conventional container 104, such as a garbage can. The bag spreader 100 fits over an edge of the container 104 and operates to hold the bag 102 in place. As will be discussed further below, the bag spreader 100 holds the bag 102 not only at the edge of the container 102, but also extends into the container and supports the bag 102 inside the container when the container is tipped onto its side.

Figure 2:
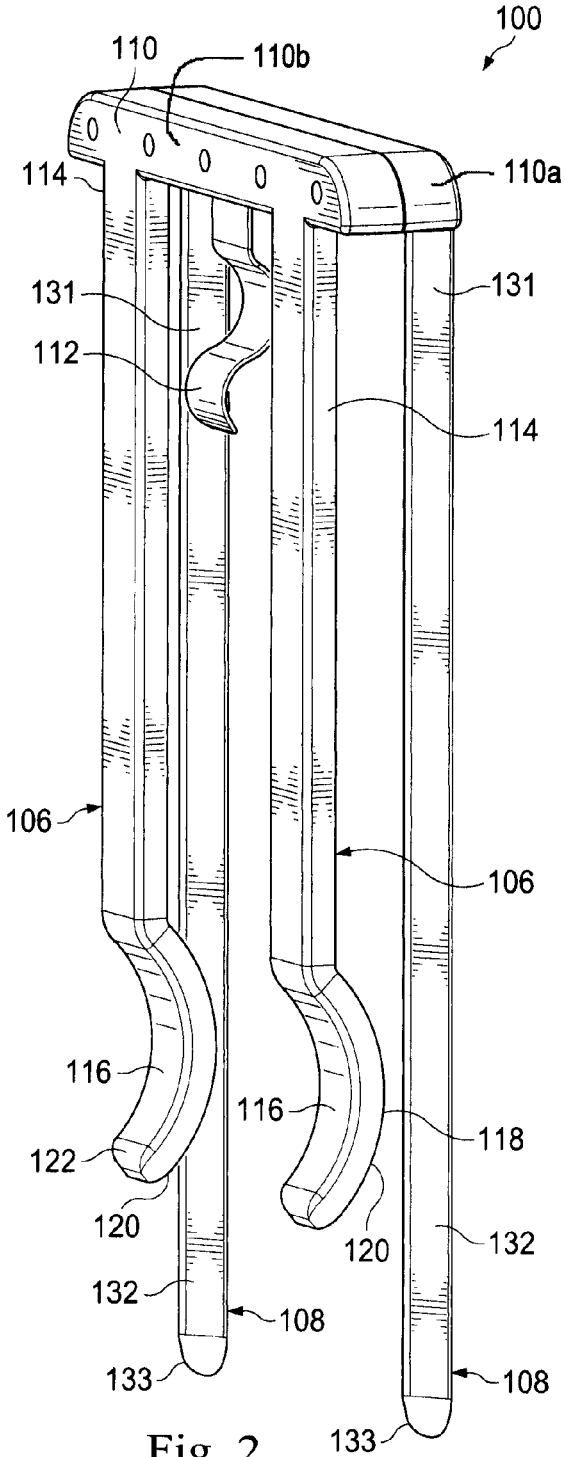
FIGS. 2 and 3 are illustrations of the exemplary bag spreader of FIG. 1.
Figure 3:
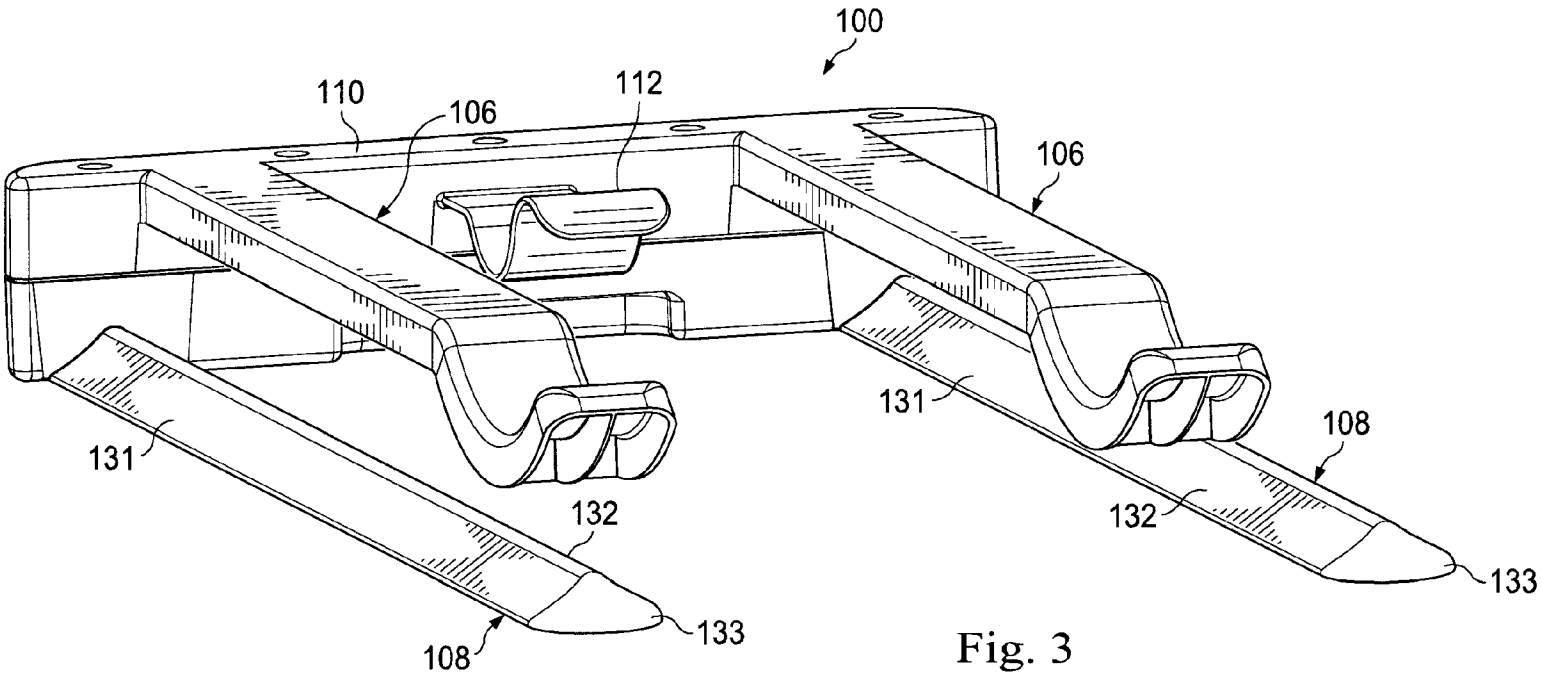

FIGS. 2 and 3 illustrate the exemplary bag spreader 100 in greater detail. The bag spreader 100 includes a connection portion as a plurality of outer legs 106, a bag supporting portion as a plurality of inner legs 108, a head portion as a handle 110, and an attachment element 112. The handle 110 include an inner portion 110*a* and an outer portion 100*b*. As can be seen in FIGS. 2 and 3, the plurality of outer legs 106 are disposed substantially in a first plane and the plurality of inner legs 108 are disposed substantially in a second plane, offset from and substantially parallel to the first plane. The plurality of outer legs 106 are configured and arranged to fit along the outer side of the container 104 in the manner shown in FIG. 1. These outer legs 106 have a proximal portion 114 adjacent the handle 110 and a distal portion 116. As can be seen, the proximal portion 114 extends rigidly from the handle 110 and is formed to be substantially straight. The distal portion 116, disposed at the end of the proximal portion 114, includes a protruding portion 118 protruding inwardly toward the inner legs 108. This protruding portion 118 includes a curved or tapered leading end 120 curving or angling away from the inner legs 108 to a distal end 122. This is described in greater detail with reference to FIG. 4.

Figure 4:
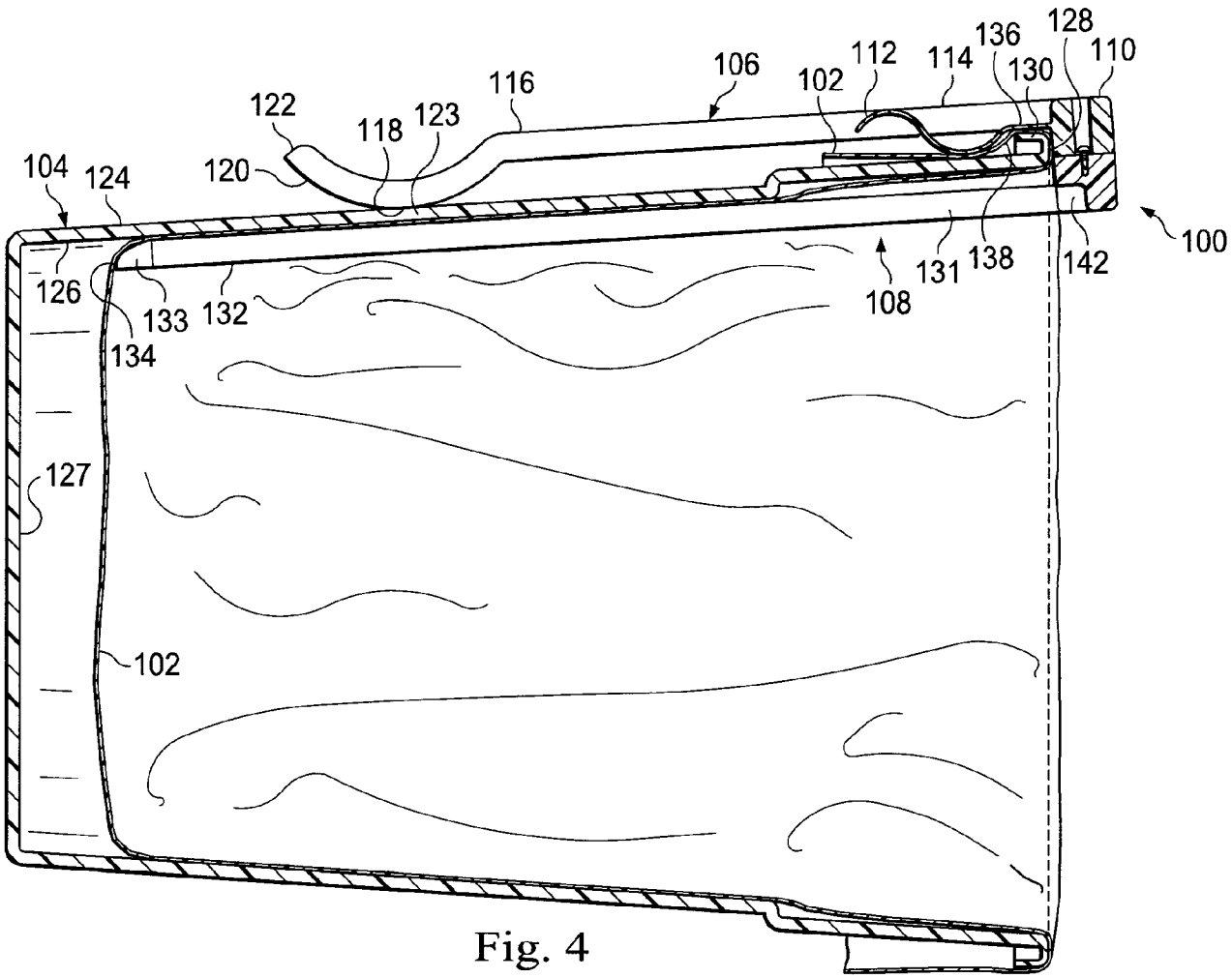
FIG. 4 is an illustration of a cross-sectional view of the system of FIG. 1.

FIG. 4 is a cross-sectional view of the bag spreader 100, the bag 102, and the container 104. Here, the container 104 has been tipped onto its side so that the opening is at a lateral side and a sidewall 123 forms an upper wall. As can be seen, the container sidewall 123 includes an outer surface 124 and an inner surface 126. The bottom end 127 of the container 104 is opposite the open end. In the exemplary embodiment shown, the container 104 includes a container edge 128 defining the container opening. In this example, the edge 128 includes a lip 130.

When disposed on a container, such as the container 104 tipped on its side, the protruding portion 118 of the outer legs 106 interfaces with the upwardly facing outer surface 124 of the container 104. This protruding portion 118 cooperates with the container 104 to maintain the outer legs 106 and inner legs 108 in an orientation where the outer and inner legs 106, 108 are disposed substantially parallel to the inner surface 126 of the container 104. This enables the inner legs 108 to more effectively hold the bag 102 adjacent the inner surface 126 of the container 104. In addition, the curved or tapered leading end 120 enables a user to more easily slide the bag spreader 100 over the container edge 128, as the curved or tapered leading end 120 can guide the outer legs 106 over the edge 128.

The inner legs 108 will now be described with reference to FIGS. 2-4. The inner legs 108 extend substantially parallel to the outer legs 106. Like the outer legs 106, the inner legs 108 are rigid and cantilevered from the handle 110. These have a proximal portion 131 adjacent the handle 110 and have a distal portion 132 with a distal end 133. In the example shown, the inner legs 108 have a length greater than the length of the outer legs 106, such that in use, they are disposed closer to the bottom end 127 of the container 104. This helps the inner legs support the bag 102 deep into the container 104, as shown in FIG. 4.

In the exemplary embodiment shown, the inner legs 106 are sized to cooperate with the container 104 by extending along the container inner surface 126 about two-thirds of the depth of the container. However, the inner legs 108 may be arranged to cooperate with a specific container and may extend, for example, to a container depth within the range of about 15% to 100% of the total container depth. In other examples, the inner legs 108 extend within a range of about 35% to 100% of the total container depth. In some embodiments, the inner legs 108 are arranged to cooperate with a container by extending more than half of the depth of the container. In some embodiments, the inner legs have a length in the range of 12 to 48 inches, although the legs may be either larger or smaller. In some embodiments, the inner legs having a length within the range of about 18 to 36 inches, and in some embodiments, the inner legs have a length within the range of about 24-36 inches. Because the inner legs 106 extend deep into the container 104, rather than just attaching at the container edge, the bag 102 does not sag at the container opening. Instead, the bag is supported near the opening and deep into the container. Accordingly, when the container is on its side as in FIG. 4, the bag 102 is better held out of the way of debris being pushed into the container opening. This makes loading the bag easier because it reduces the chance of debris snagging on the bag, and it also protects the bag, reducing the change of tearing or otherwise damaging the bag. This may directly lead to more efficient bagging of debris.

Figure 5:
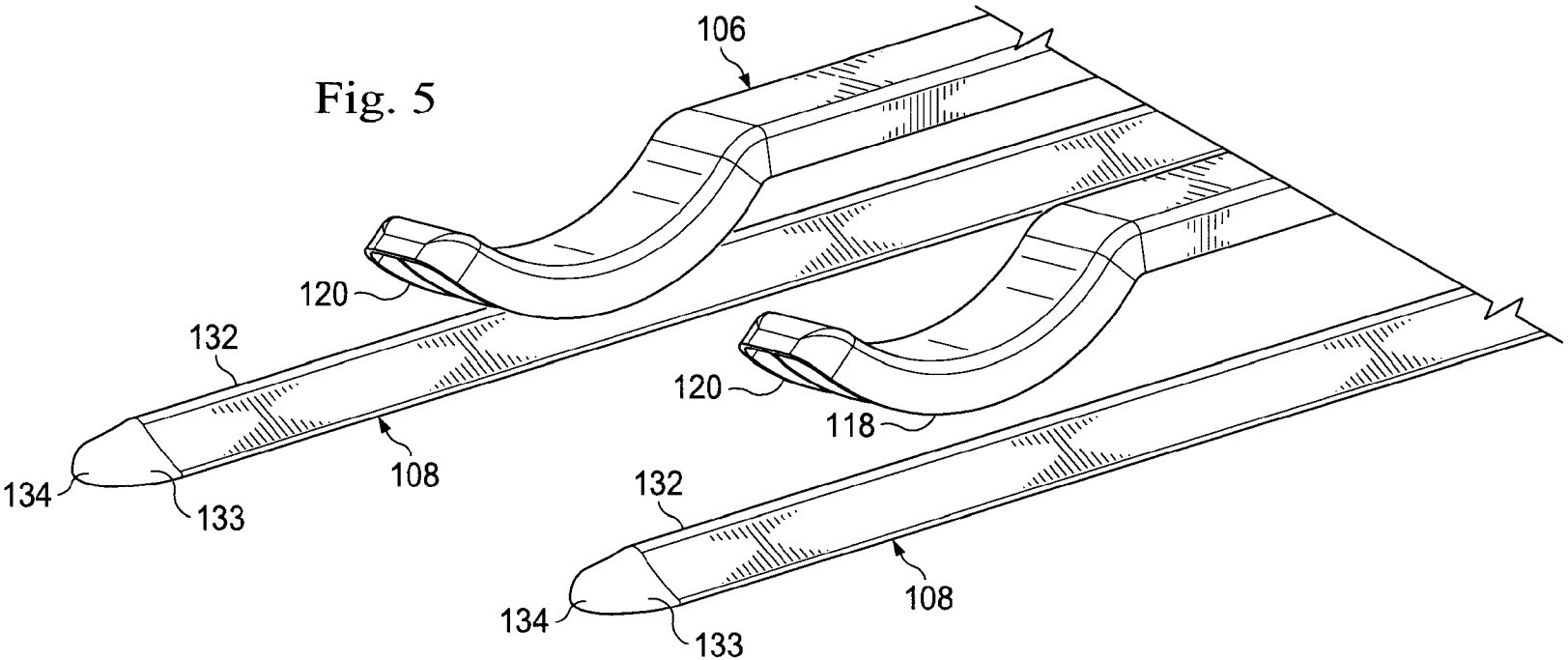
FIG. 5 is an illustration of ends of legs of the exemplary bag spreader of FIG. 1.
Figure 6:
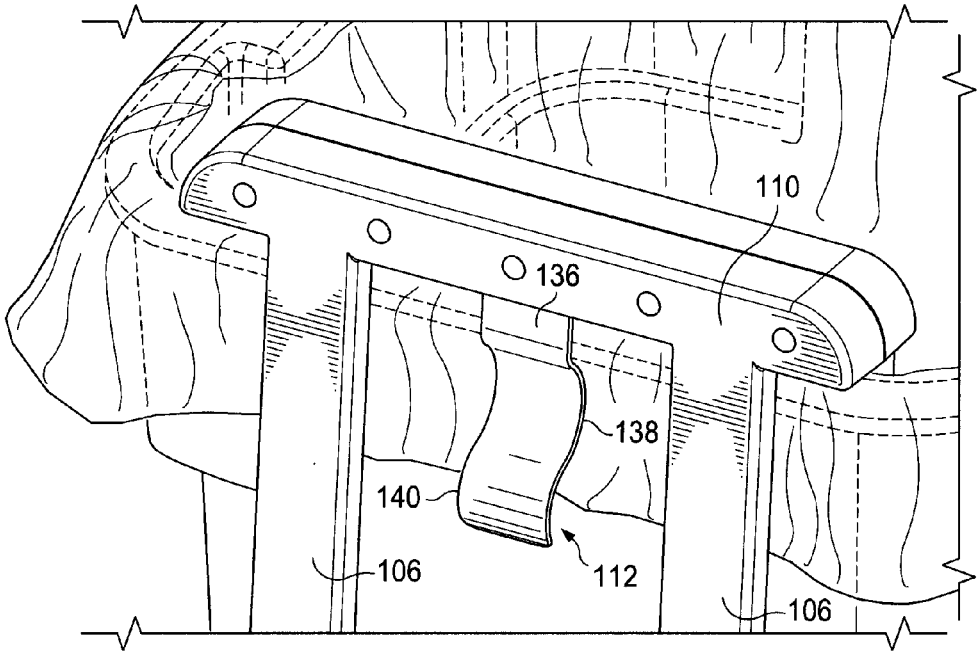
FIG. 6 is an illustration of a flexible clip portion of the exemplary bag spreader of FIG. 1.

As best seen in FIGS. 4 and 5, the distal end 133 includes a rounded or tapered leading edge 134 that enables the distal end 133 to smoothly slide along a bag in the container 104. This reduces the chance of damaging the bag 102 in the container 104. In addition, the rounded or tapered leading edge 134 may aid when introducing the spreader 100 over the edge 128 of the container 104 by guiding the inner legs 106.

The attachment element 112 is shown in FIGS. 1-4 and 6. It cooperates with the container 104 to hold the bag spreader 100 on the container. In the example shown, the attachment element 112 is a sheet-like compliant mechanism integrally formed with the spreader and elastically flexes to fit over the container edge 128. In this example, the attachment element 112 includes a proximal portion 136 extending parallel to the legs 106, 108. This proximal portion 136 may be configured to fit adjacent the container lip 130, as shown in FIG. 4. From the proximal portion, the attachment element 112 curves toward the inner legs 108 to form a protrusion 138 that interfaces with the outer surface 124 of the container. By engaging the outer surface 124 distal of the container lip 130, the attachment element 112 helps secure the spreader 100 on the container 104. A distal portion 140 of the attachment element 112 is arranged to be spaced from the outer surface 124 of the container 104 for easy grasping when in use. This enables a user to manually elastically flex the attachment element 112 to more easily remove the spreader 100 from a container. It is worth noting that the attachment element 112 is shaped to flex to both be attached to and removed from a container without being independently flexed by a user.

Figure 7:
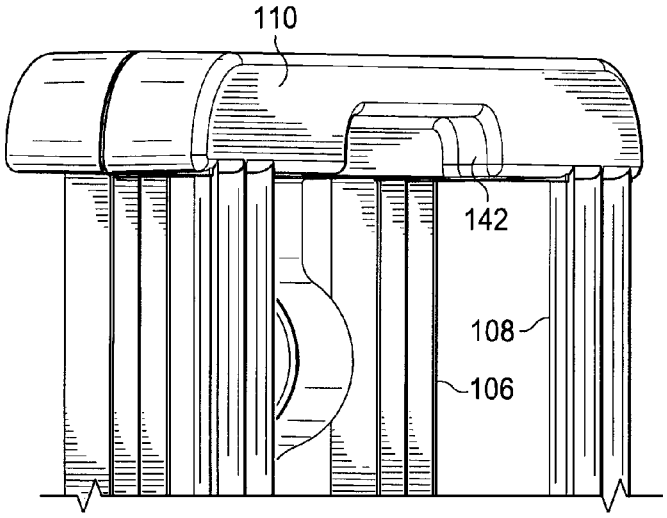
FIG. 7 is an illustration of a handle portion of the exemplary bag spreader of FIG. 1.

The handle 110, shown in all the Figures, is the structure connecting the legs and the attachment element. As shown in FIGS. 1 and 4, it is arranged to lie adjacent the container edge 128 in use. FIG. 7 shows the handle 110 in greater detail. In the example shown, the handle 110 includes a grip 142 formed therein that allows a user to hold the spreader when placing it on or taking it off a container. In this embodiment, the grip 142 is formed as a depression in the handle 110 on the sides that face the container edge 128 and that include the inner legs 108.

Figure 8:
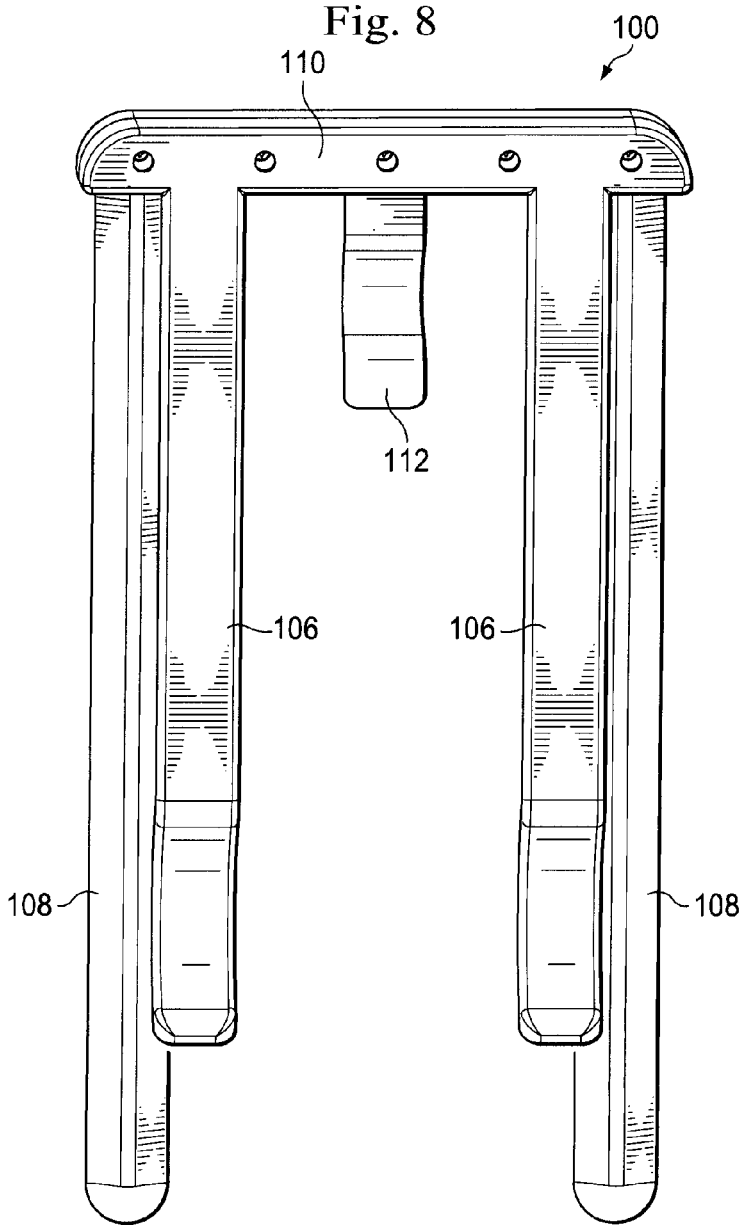
FIG. 8 is an illustration of a frontal view of the exemplary bag spreader of FIG. 1.

Referring now to FIG. 8, the inner legs 108 are shown spaced apart from each other by a distance greater than that of the outer legs 106. In other examples, the inner legs 108 are spaced apart the same distance as the outer legs 106.

Figure 9A:
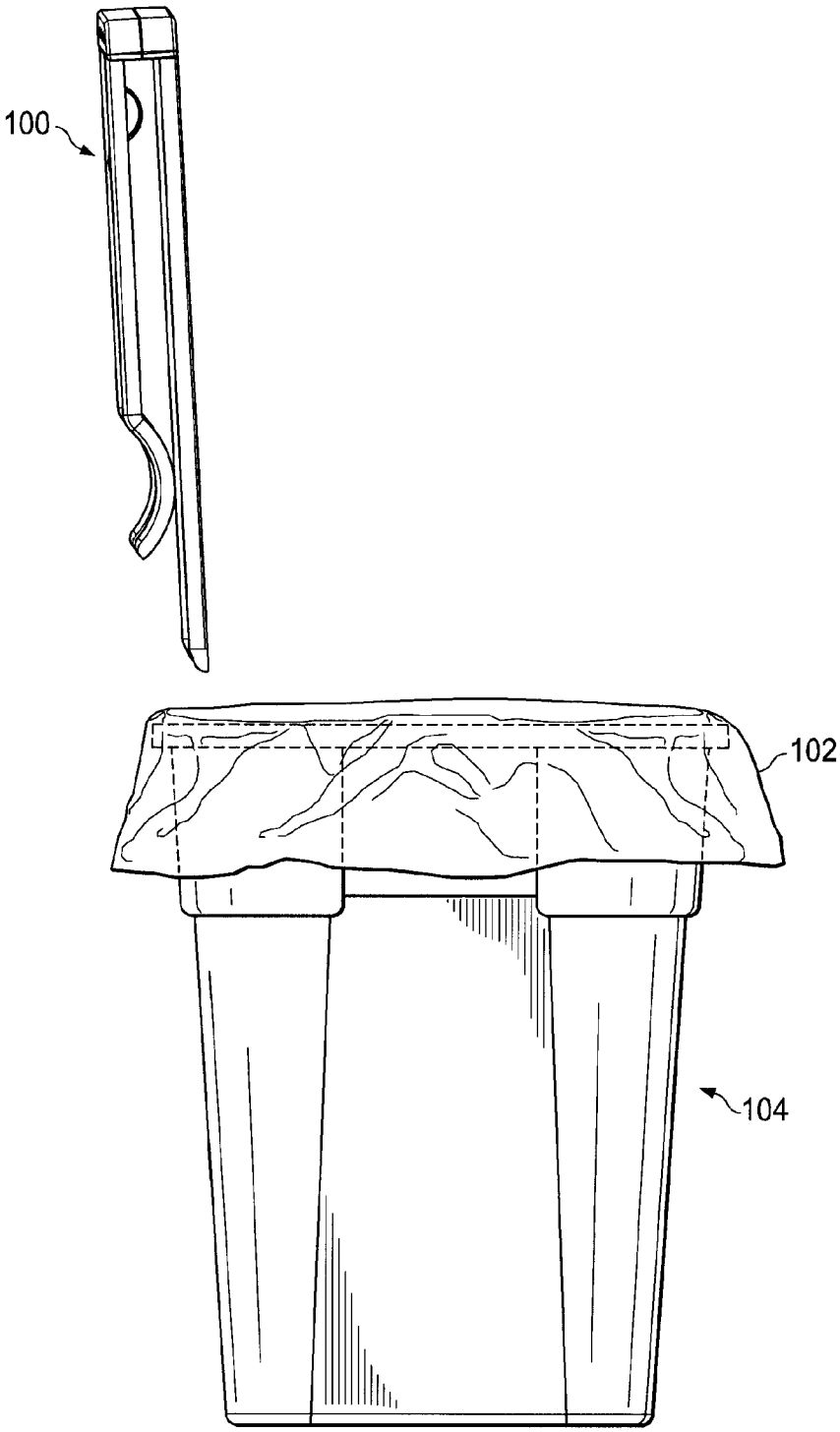
FIGS. 9A and 9B are illustrations showing the exemplary bag spreader of FIG. 1 being placed on the container 104.
Figure 9B:
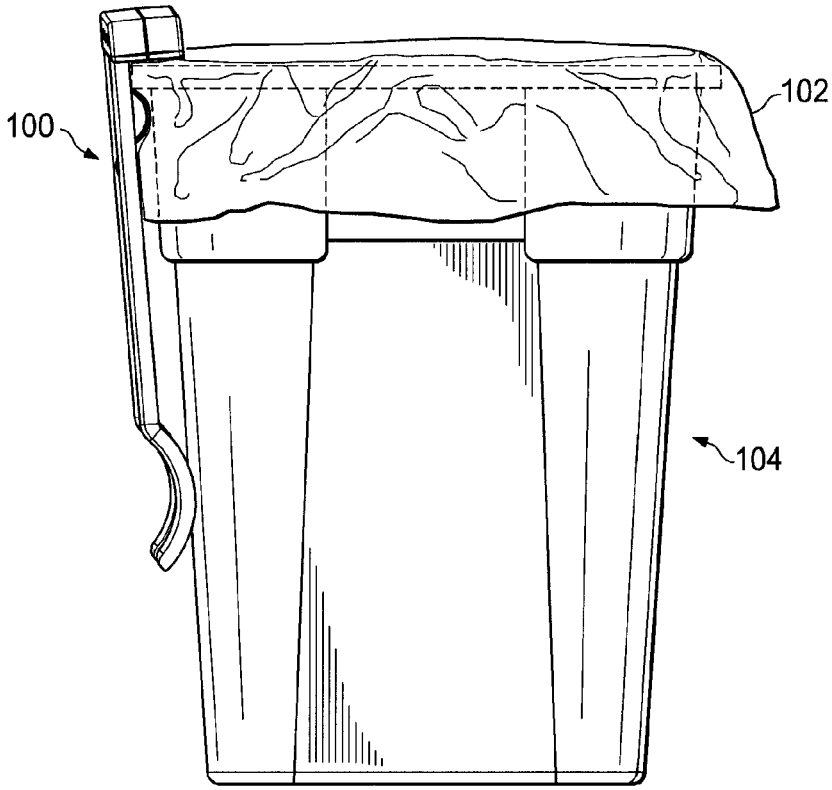

In use, a bag 102 may be placed into a container 104 such that the bag opening corresponds to the container opening, as is shown in FIG. 9A. In some instances, the bag 102 may be folded about the edges of the container 104 so that the edge of the bag open end is exterior of the container opening and the container edge is entirely covered by the bag. The bag spreader 100 is then disposed over the edge of the container 104 so that the legs extend into the container along a sidewall adjacent to both an inner and an outer surface of the container 104, as shown in FIGS. 4 and 9B.

With the bag and spreader in place, the container may be tipped on its side so that the opening lies adjacent the ground. If the bag is disposed to extend over the edge of the container, as shown in FIGS. 4, 9A, and 9B, the attachment element 112 and the outer arms 106 may help hold the bag in place along the outwardly facing side of the container. For example, a portion of the spreader's weight may lie on the bag 102 at the lip 130 of the container edge 128 when the container is tipped on its side. Accordingly, in addition to supporting the bag with the inner legs 108, the bag may be held in place by the attachment element 112 and the outer arms 106.

With the container on its side, a user can rake leaves and other debris directly into the bag. The spreader supports the bag at the top edge of the container when the container is on its side. It also supports the bag inside the container, not just near the opening, but also further in toward the closed end of the container so that the bag doesn't hang as much as it otherwise would.

In the example shown, the container 104 is a square shaped container having substantially straight edges forming the opening. One such square container is marketed by Rubbermaid® under the tradename Brute® Utility containers. Square containers are particularly useful when raking debris into the can because one edge can lie parallel with the ground. However, other containers suitable for use with the spreader disclosed herein have shapes other than square shaped. For example, in some embodiments, the container is a round container having a circular opening, and the spreader 100 cooperates with the round container to hold the bag in the round container. It should be apparent that other containers in addition to the square and round containers may be used, including containers having round openings, rectangular openings, oval openings, among other. It should also be apparent that in some embodiments, the bag spreader 100 is formed to fit the edge of the container in a manner that helps hold the bag within the container in the manner described above. In some embodiments where the container has a curved opening, such as with a round container, the bag spreader head portion is curved to match the curvature of the container opening. In other embodiments, the bag spreader head portion is straight as shown in FIG. 2.

In some examples, more than one spreader is used with a single container. For example, two or more spreaders may be used with a single container to secure and hold open the bag. In one example, the spreaders are used on opposing sides of the container. In another example, the spreaders are used on adjacent sides, and in yet other examples, the spreaders are used on the same side of the container.

Although disclosed as a leaf collector, the spreader may be used in any application to collect and bag material. For example, it may be used to collect and bag shavings from animal stalls, gardening mulch, twigs, foliage, weeds, saw dust, trash, debris, or any other material that might be bagged.

It is worth noting that the spreader 100 can be used to not only support the bag inside the container, spaced apart from the container opening to reduce bag sagging when the bag is on its side, but it can also be used to secure and hold the bag in place when the container is upright. Because some embodiments extend both inside and outside of the associated container, and because some embodiments rest on the edge of the container, the spreader helps secure the bag in place at all times.

Since the spreader is useful in bagging applications, some spreader embodiments are sized to cooperate with conventional 33 gallon bags or larger. As such, the legs are sized to extend deep into such bags to support the bags and prevent bag sag.

The foregoing has outlined features of several embodiments. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A bag spreader for spreading a bag in a container lying on its side such that the container opens on a lateral side and such that the container includes an upper sidewall having an upwardly facing outer surface, the bag spreader comprising:

a plurality of outer legs arranged to interface with the upwardly facing outer surface of the container when the container is oriented on its side;

a bag supporting portion arranged for insertion into the bag and the container, the bag supporting portion being disposed in the container in a manner that supports the bag in an open condition when the container is oriented on its side;

a head portion connected to the plurality of outer legs, the plurality of outer legs extending from the head portion in a first direction, the head portion also connected to the bag supporting portion, the bag supporting portion extending from the head portion in the first direction, the plurality of outer legs and the bag supporting portion being spaced apart on the head portion a distance sufficient to receive an edge of the container such that when the plurality of outer legs interfaces with the outer surface of the container, the bag supporting portion is disposed within the bag in the container, the head portion being structurally arranged to lie adjacent the edge of the container when the plurality of outer legs interfaces with the outer surface of the container and the bag supporting portion is disposed within the bag in the container; and a compliant attachment element connected to and extending from the head portion adjacent the plurality of outer legs, the attachment element being shaped to curve from the head portion toward the bag supporting portion to interface with the container to help secure the bag spreader to the container.

2. The bag spreader of claim 1, wherein the attachment element has an S-shape and is arranged to flex to extend over a lip of the container when the bag spreader is being attached or removed from the container.

3. The bag spreader of claim 1, wherein the bag supporting portion is arranged to cooperate with the container to extend into the container more than 15% of the depth of the container.

4. The bag spreader of claim 1, wherein the head portion comprises a grip configured to be grasped by a user when attaching or removing the spreader from the container.

5. The bag spreader of claim 1, wherein the bag supporting portion comprises a plurality of inner legs.

6. The bag spreader of claim 5, wherein the plurality of outer legs are spaced apart from each other by a first distance and the plurality of inner legs are spaced apart from each other by a second distance, the second distance being greater than the first distance.

7. The bag spreader of claim 1, wherein the plurality of outer legs extends substantially parallel to the bag supporting portion, and wherein each of the plurality of outer legs comprises a protruding portion protruding toward the bag supporting portion to interface with the outer surface of the container and orient the bag spreader.

8. The bag spreader of claim 1, wherein the bag supporting portion comprises a rounded or tapered distal end.

9. The bag spreader of claim 1, wherein the plurality of outer legs extends from the head portion by a first length and the bag supporting portion extends from the head portion by a second length, the second length being greater than the first length.

10. A bag spreader for spreading a bag in a container lying on its side such that the container opens on a lateral side and such that the container includes an upper sidewall having an upwardly facing outer surface, the bag spreader comprising:

a first plurality of legs lying substantially in a first plane, the first plurality of legs being arranged to interface with an outer surface of the container;

a second plurality of legs lying substantially in a second plane, the second plane being substantially parallel to the first plane, the second plurality of legs being arranged for insertion into the container and into the bag in the container in a manner that supports the bag a distance spaced from the container opening, the first and second planes being offset a distance sufficient to receive an edge of the container such that when the first plurality of legs interfaces with the outer surface of the container, the second plurality of legs is disposed within the container;

a head portion connecting the first and second plurality of legs so that the first plurality of legs and the second plurality of legs extend in substantially parallel directions; and a compliant attachment element connected to and extending from the head portion adjacent the first plurality of legs, the attachment element being shaped to curve from the head portion toward the second plurality of legs to interface with the container to help secure the bag spreader to the container.

11. The bag spreader of claim 10, wherein the head portion comprises a first side and a second side with a grip formed in the first side configured to be grasped by a user when attaching or removing the spreader from the container.

12. The bag spreader of claim 10, wherein each leg of the first plurality of legs comprises a protruding portion protruding toward the second plurality of legs.

13. The bag spreader of claim 10, wherein each leg of the first and second pluralities of legs have rounded or tapered leading edges.

14. The bag spreader of claim 10, wherein the first plurality of legs comprises two substantially parallel legs and the second plurality of legs comprises two substantially parallel legs.

15. The bag spreader of claim 10, wherein the second plurality of legs having a length greater than the first plurality of legs.

16. A bag spreader for spreading a bag in a container lying on its side such that the container opens on a lateral side and such that the container includes an upper sidewall having an upwardly facing outer surface, the bag spreader comprising:

a plurality of outer legs structurally arranged to interface with the upwardly facing outer surface of the container when the container is oriented on its side, each of the plurality of outer legs having a proximal portion and a distal portion, the proximal portion being extending substantially straight in a first direction and the distal portion having a curve forming a protruding portion;

a plurality of inner legs structurally arranged for insertion into the bag and the container when the plurality of outer legs are interfacing with the upwardly facing outer surface of the container, the plurality of inner legs being disposed in the container in a manner that supports the bag in an open condition when the container is oriented on its side; and a head portion attached to and connecting each of the plurality of outer legs and attached to and connecting each of the plurality of inner legs in a manner that the plurality of outer legs and the plurality of inner legs extend from head portion substantially parallel to each other in the first direction, the plurality of outer legs and the plurality of inner legs being connected to and spaced apart on the head portion a distance sufficient to receive an edge of the container when the plurality of outer legs interface with the outer surface of the container, the plurality of inner legs are disposed within the bag in the container, each of the plurality of inner legs and each of the plurality of outer legs having a length greater than about twenty-four inches, the head portion being structurally arranged to lie adjacent the edge of the container when the plurality of outer legs interface with the outer surface of the container and the plurality of outer legs are disposed within the bag in the container, the head portion having an outer side flush with the plurality of outer legs and having an inner side flush with the plurality of inner legs, the protruding portion of the plurality of outer legs protruding in a direction toward the plurality of inner legs in a manner that the distance between the inner legs and the protruding portion is less than the distance between the inner legs and the outer legs as measured adjacent the head portion.

17. The bag spreader of claim 16, further comprising a curved compliant attachment element extending from the head portion and disposed in a gap between the plurality of outer legs, the compliant attachment mechanism being structurally arranged to flex about an edge of the container when the bag spreader is introduced onto the container.

18. The bag spreader of claim 16, wherein each of the plurality of inner legs has a first angled surface and a second angled surface that meet at an apex facing toward the outer legs to interface with and support the bag when the bag spreader is disposed on the container.

19. The bag spreader of claim 16, wherein the inner side comprises a handle grip formed therein in a gap between the plurality of inner legs.

20. A bag spreader for spreading a bag in a container lying on its side such that the container opens on a lateral side and such that the container includes an upper sidewall having an upwardly facing outer surface, the bag spreader comprising:

one or more outer legs arranged to interface with the upwardly facing outer surface of the container when the container is oriented on its side;

one or more bag-supporting inner legs arranged for insertion into the bag and the container, the one or more bag-supporting inner legs being disposable in the container in a manner that supports the bag in an open condition when the container is oriented on its side;

a head portion comprising an outer head portion and an inner head portion, the inner head portion abutting against the outer head portion when the inner head portion and outer head portion are connected to each other, the outer head portion being connected to and carrying the one or more outer legs, the one or more outer legs extending from the outer head portion in a first direction, the inner head portion connected to and carrying the one or more bag-supporting inner legs, the one or more bag-supporting inner legs extending from the head portion in the first direction when the outer head portion and inner head portion are connected, the one or more outer legs and the one or more bag-supporting inner legs being spaced apart on the head portion a distance sufficient to receive an edge of the container such that when the one or more outer legs interfaces with the outer surface of the container, the one or more bag-supporting inner legs is disposed within the bag in the container, the head portion being structurally arranged to lie adjacent the edge of the container when the one or more outer legs interfaces with the outer surface of the container and the one or more bag-supporting inner legs is disposed within the bag in the container.

21. The bag spreader of claim 20, further comprising a screw extending transverse to said first direction, the screw attaching the inner head portion and the outer head portion.

* * * * *